United States Patent [19]

Heath

[11] Patent Number: 4,679,963

[45] Date of Patent: Jul. 14, 1987

[54] PLAYGROUND CONSTRUCTION

[76] Inventor: Robert G. Heath, 823 West St., Harrison, N.Y. 10528

[21] Appl. No.: 866,671

[22] Filed: May 27, 1986

[51] Int. Cl.[4] ..... E02B 13/00

[52] U.S. Cl. ..... 405/36; 52/169.5; 52/742; 47/1 R; 272/3; 405/45

[58] Field of Search ..... 52/169.5, 742; 272/3; 405/258, 36, 45; 47/1

[56] References Cited

U.S. PATENT DOCUMENTS

| | | | |
|---|---|---|---|
| 3,083,542 | 4/1963 | Summers | 111/73 |
| 4,296,884 | 10/1981 | Luebke | 405/36 |
| 4,366,846 | 1/1983 | Curati | 405/36 |
| 4,538,387 | 9/1985 | Barnett | 52/169.5 |
| 4,624,604 | 11/1986 | Wagner | 405/53 |

FOREIGN PATENT DOCUMENTS

| | | | |
|---|---|---|---|
| 85742 | 8/1982 | European Pat. Off. | 405/258 |
| 2422772 | 11/1979 | France | 405/36 |
| 59-230 | 4/1985 | Japan | 405/36 |
| 2035098 | 6/1980 | United Kingdom | 405/36 |

*Primary Examiner*—Henry E. Raduazo

*Attorney, Agent, or Firm*—Sughrue, Mion, Zinn, Macpeak, and Seas

[57] ABSTRACT

A playground construction comprises an earthen floor beneath the surface of the earth, a trough extending downwardly beneath the floor and having drainage means therein. The floor and trough are lined with a water pervious fabric and an aggregate of drainage stone is utilized to fill the trough and to cover an area of the floor. The fabric material has overlapping edges which are secured together thus providing an envelope for the aggregate stone. A second layer of aggregate wood fiber is placed above the enveloped stone aggregate and terminates at the surface of the earth.

11 Claims, 3 Drawing Figures

PLAYGROUND CONSTRUCTION

BACKGROUND OF THE INVENTION

1. Field of the Invention:

This invention pertains to children's playground structures such as may be seen at schools, municipal grounds, parks and the like where various playthings such as slides, stationary riding devices and other stationary playthings are set in the earth.

2. Background of the Prior Art:

The prior art discloses playing surfaces for athletic games which employ, among other things, pile fabric having a moistureproof backing and other synthetic materials which are placed on the earth.

Representative of the prior art are patents listed below and copies are furnished for the records.

| Inventor | U.S. Pat. No. | Title |
|---|---|---|
| W. F. Taylor | 1,171,558 | Plant Growing Apparatus |
| J. F. Timberlake | 2,158,952 | Conservation and Preservation of Top Soil |
| Hass, Jr. | 4,044,179 | Playing Surface for Athletic Games |
| Tomarin | 4,497,853 | Synthetic Turf Carpet Game Playing Surface |

SUMMARY OF THE INVENTION:

Present day children's playground surfaces employ materials such as sand, pea gravel, wood bark, rubber and synthetic surfaces made of various foam such a polyethylene.

Surfaces made with these materials have inherent disadvantages in that they do not provide adequate protection against injury to children due to falls. Moreover, these materials are unsatisfactory in that they do not provide adequate drainage means which will be evident in the numerous puddles which occur after a rain shower.

Therefore, there is a need for a children's playground having a playing surface which provides maximum protection against injury due to falls yet provides optimum drainage and is easy and ecomomical to install.

Another object of this invention is to provide a children's playgroud which is aesthetically pleasing to look at yet functions to minimize injury to children due to falls.

It is another object of this invention to provide a children's playground which has resilient properties to cushion the fall of children.

Still another object of this invention is to provide a children's playground which utilizes an amalgam of processed wood fiber, selected for longevity, fibrous qualities and durability.

Yet another object of this invention is to provide a children's playground which provides maximum drainage thus eliminating water puddles and which is almost dust free and does not harbor living organisms.

These and other objects of the invention will become apparent to those skilled in the art to which the invention pertains from a reading of the following specification when taken in light of the annexed drawings.

DESCRIPTION OF THE PREFERRED EMBODIMENT OF THE INVENTION

Figure 1:
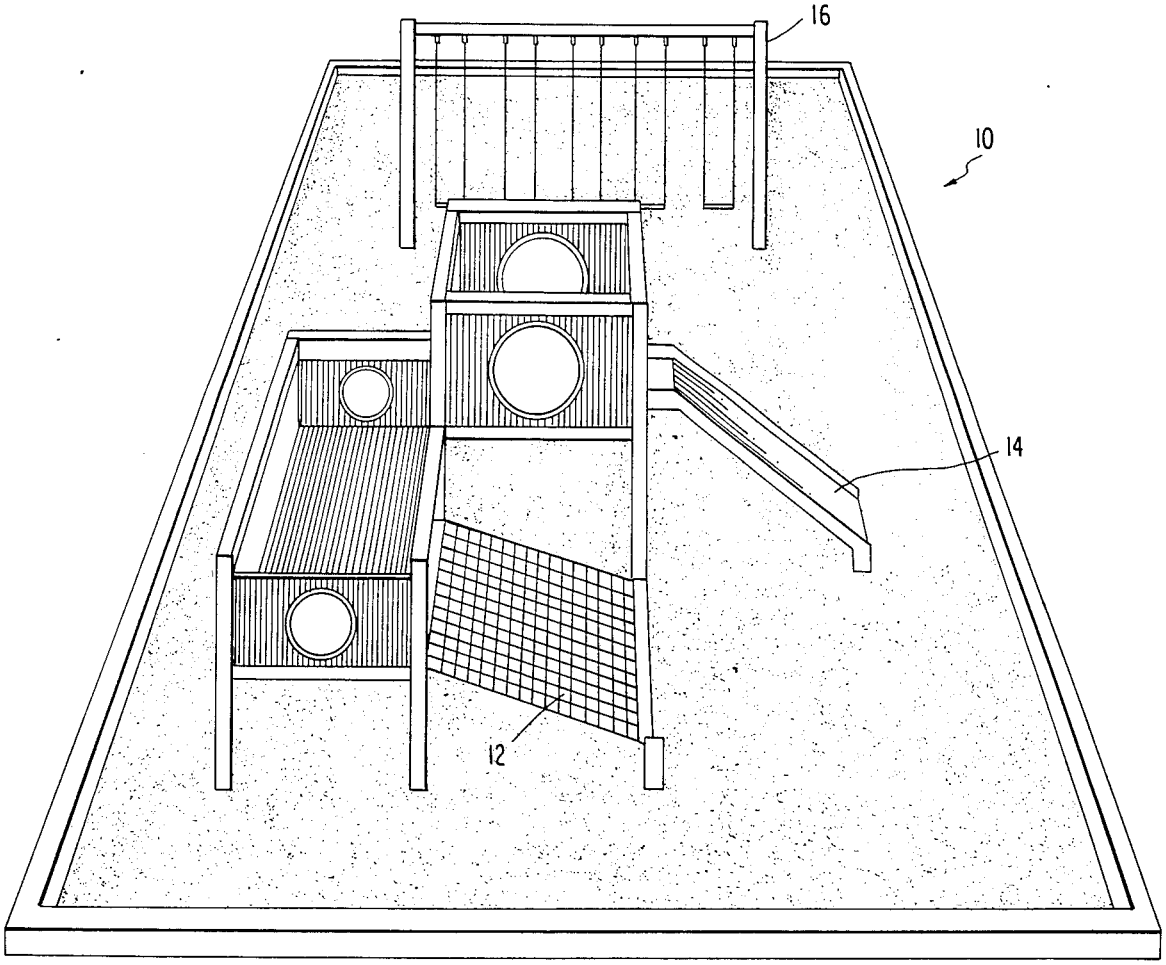
FIG. 1 is a plan view of a children's playground constructed according to the teachings of this invention.

Referring now in more detail to the drawings, FIG. 1 shows a children's playground 10 having a number of stationary rides 12, slides 14 and seesaw devices 16 as are customarily found in such play areas.

Figure 2:
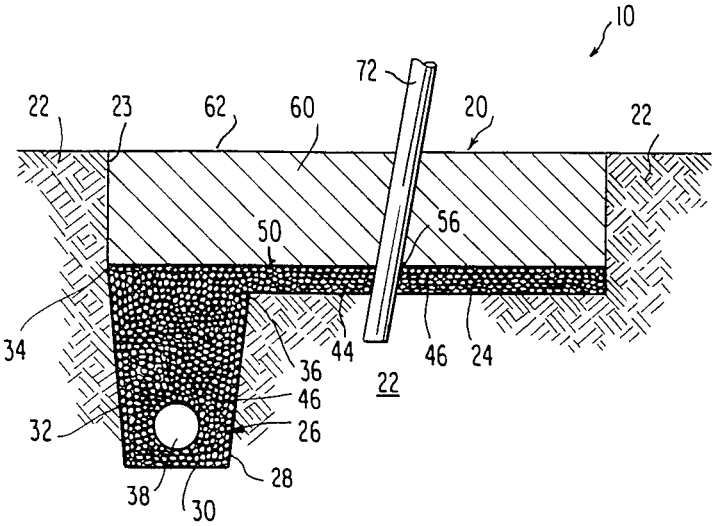
FIG. 2 is a cross-sectional view in section showing numerous layers of materials used in constructing the playground.
Figure 3:
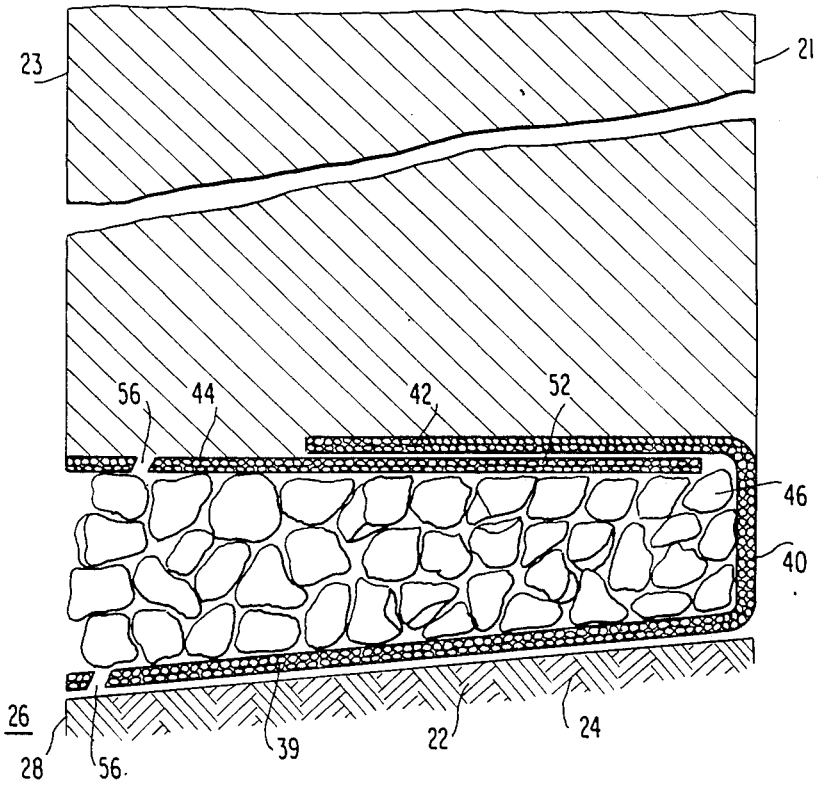
FIG. 3 is a blown-up cross-sectional view as seen in FIG. 2.

FIG. 2 shows a cross-sectional view of the playground 10. An are 20 of approximately 15" deep is excavated in the earth 22. The floor 24 is earthen and has a grade of 1° to insure optimum drainage. The area 20 is thus defined by walls 21 and 23 and the sloping earthen floor 24. The area 20 constitutes a children's playground of any size desired.

A trough 26 of about 20" deep has a longitudinal extent equal to one of the boarders of the playground. The trough 26 has a downwardly and inwardly extending wall 28 descending from the floor 24 and terminating at floor 30 which is also earthen. A second wall 32 descends downwardly and inwardly from wall 23 and it also terminates at floor 30. It will be seen that the point 34 of the beginning of the inclination of wall 32 begins at a location above the point 36 of inclination of wall 28. A perforated conduit 38 having a longitudinal extent substantially equal to that of the trough is positioned equidistantly between the walls 28 and 32 and a distance above the floor 30. The distance between the floor 30 and the wall of the conduit 38 at their nearest points is less than the distance between the walls 28 and 32 and the pipe at their nearest points.

A layer of fabric 39 such as that sold under the trademark FIBERFELT has a short section 40 extending upwardly a distance against wall 21 and has a flap section 42 of about 12 inches, the purpose of which will be explained below. The fabric 39 lines floor 24 from wall 21 and descends downwardly along wall 28 across floor 30 and upwardly on wall 32 to point 34. There will be a sufficient quantity of fabric remaining to form a blanket 44 of sufficient length to extend to wall 21, terminating a short distance therefrom.

A layer of one-half to three-quarter inch open aggregate drainage stone 46 fills the trough 26 to point 34. The floor 24 is also covered with stone a height equal to the height of the felt segment 40. It will be apparent that the top layer 50 of stone 46 will be substantially level between the walls 21 and 23.

The top blanket 44 of fabric 39 is drawn across the top layer 50 of the stone 46 and terminates at terminal end 52 adjacent the portion 40. The flap section 42 overlaps the terminal section 52 a minimum of 12 inches. The terminal end 52 and the flap 42 may be fastened together with suitable means such as by "C" clips. Further, the fabric layers 39 and 44 may be provided with slits 56 to be more fully explained below.

The space 20 above the fabric 44 and flap section 42 and between the walls 21 and 23 is filled with a layer 60 of wood fiber sold under the trademark FIBAR. The layer 60 of wood fiber is between 8 and 12 inches deep but may not be less than 8 inches deep. It will be appreciated that the top layer 62 will be loose wood fibers and that the area between the walls 21 and 23 define a children's playground of any size depending on the number of children in the neighborhood using the playground.

The slits 56 in the felt 39 and 44 are provided to permit passage of support members 72 for supporting the slides and rides and other devices provided for the children to play on. The slits are closed with any suitable means such as "C" clips to insure that the felt around the supports is snug there against.

It will be appreciated that the trough 26 and drain conduit 38 may be eliminated where the floor 24 provides adequate drainage. In this regard, only one layer 39 of fabric may be used.

While the invention has been described in particular detail with respect to a preferred embodiment thereof, it will be understood to those skilled in the art to which the invention pertains that numerous changes may be made in the invention without departing from th spirit and scope thereof.

What is claimed is:

1. A playground construction comprising:

an earthen floor distance beneath the surface of the earth having a grade of at least 1°;

opposing walls extending upwardly from said floor to the surface of the earth;

a trough in said floor adjacent to one of said walls;

a layer of water-pervious material lining said trough and said floor and having a blanket section at one end and a flap section at the other end;

a first layer of aggregate material in said trough and on said floor;

said first layer of aggregate material enveloped by said layer of water-pervious material, blanket section and flap section; and a second layer of aggregate material different in compostion from the first layer and extending above said first layer of aggregate material and terminating at the surface of the earth.

2. A playground construction according to claim 1, wherein:

said first layer of aggregate material comprises one-half to three-quarter inch open aggregate drainage stone.

3. A playground construction according to claim 1, wherein:

said layer of water pervious material comprises polyester fabric.

4. A playground construction according to claim 3 and:

said fabric is comprised of polyester and is 85 mils thick.

5. A playground construction according to claim 1 wherein:

said second layer of aggregate comprises wood fiber.

6. A playground construction according to claim 5 and:

said wood fiber comprises particles ranging in length from 1/64" to 1 and ¼" and ranging in width from 1/32" to ½" and ranging in depth from 1/64" to ¼".

7. A playground construction comprising:

an earthen floor a distance beneath the surface of the earth;

opposing walls extending upwardly from said floor;

a trough in said floor;

a layer of water-pervious material lining said trough and said floor and having a blanket section at one end and a flap section at the other end;

drainage means in said trough substantially beneath said floor;

a first layer of aggregate material in said trough and about said drainage means and on said floor extending a distance above the floor;

said first layer of aggregate material enveloped by said layer of water-pervious material, blanket section and flap section; and a second layer of aggregate material different in composition than from the first layer and extending above said first layer of aggregate material and terminating at the surface of the earth.

8. A playground construction according to claim 7, and:

said drainage means being a perforated pipe extending the length of the trough and positioned equidistantly between the walls and a distance above the floor.

9. A playground construction comprising:

an earthen floor a distance beneath the surface of the earth;

opposing walls extending upwardly from said floor;

a trough in said floor having inwardly extending walls and a floor;

a layer of water-pervious material lining said trough and said floor and having a blanket section at one end and a flap section at the other end;

drainage means in said trough between said walls and above said floor;

a first layer of aggregate material in said trough and about said drainage means and on the earthen floor extending a distance above said earthen floor;

said first layer of aggregate material enveloped by said layer of water-pervious material, blanket section and flap section; and a second layer of aggregate material different in composition from said first layer and extending upwardly from said first layer terminating at the surface of the earth.

10. A playground construction comprising:

an earthen floor a distance beneath the surface of the earth having a grade of at least 1°;

opposing sidewalls extending upwardly from said floor to the surface of the earth;

a trough in said floor adjacent to one sidewall;

a layer of fabric on said floor and in said trough and having a blanket section at one end and a flap section at the other end;

a first layer of aggregate material in said trough and covering said floor, said layer covered by said blanket section and said flap section in overlapping relationship; and a second layer of between 8" to 12" aggregate material different in composition than the first layer and terminating at the surface of the earth.

11. A method constructing a playground comprising:

excavating an area of earth to provide a floor having a minimum grade of 1° and having sidewalls extending to the surface of the earth;

excavating a trough in said floor adjacent to one of said sidewalls having a longitudinal extent equal to one of the borders of the playground;

placing a layer of water pervious fabric on said floor and in said trough, said layer of water pervious fabric having a blanket section at one end and a fabric section at the other end;

positioning a perforated drainage conduit in said trough extending the longitudinal extent thereof;

filling said trough and covering said floor with open aggregate drainage stone;

covering said drainage stone with said blanket section and said flap section in overlapping relationship; and filling the remainder of the excavated area with a layer of wood fiber.

* * * * *